US009520670B2

(12) United States Patent
Bazayev

(10) Patent No.: US 9,520,670 B2
(45) Date of Patent: Dec. 13, 2016

(54) TAMPER RESISTANT RECEPTACLE

(71) Applicant: Hubbell Incorporated, Shelton, CT (US)

(72) Inventor: Edward Robert Bazayev, Kew Gardens, NY (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/856,922

(22) Filed: Sep. 17, 2015

(65) Prior Publication Data

US 2016/0087368 A1 Mar. 24, 2016

Related U.S. Application Data

(60) Provisional application No. 62/053,877, filed on Sep. 23, 2014.

(51) Int. Cl.
*H01R 4/66* (2006.01)
*H01R 13/453* (2006.01)
*H01R 24/76* (2011.01)

(52) U.S. Cl.
CPC ..... *H01R 13/4536* (2013.01); *H01R 13/4534* (2013.01); *H01R 24/76* (2013.01)

(58) Field of Classification Search
CPC ..... H01R 13/4532; H01R 13/453; H01R 13/4534
USPC ..... 439/135, 137, 138, 139, 140, 141, 142,439/143, 93
See application file for complete search history.

(56) References Cited

U.S. PATENT DOCUMENTS 8,262,411 B2 * 9/2012 Kondo ..... H01R 13/6658 439/607.01
8,475,216 B2 * 7/2013 Tung ..... H01R 13/506 439/607.4
8,684,769 B2 * 4/2014 Kao ..... H01R 13/6471 439/607.28
8,851,927 B2 * 10/2014 Hsu ..... H01R 13/6594 439/607.11
8,894,451 B2 * 11/2014 Shiratori ..... H01R 13/6471 439/660
9,022,800 B2 * 5/2015 Yang ..... H01R 13/6581 439/487
9,178,319 B2 * 11/2015 Little ..... H01R 13/6585
2011/0268396 A1 * 11/2011 He ..... G02B 6/3817 385/93
2013/0316581 A1 * 11/2013 Kao ..... H01R 13/6471 439/607.28
2014/0113481 A1 * 4/2014 Little ..... H01R 13/64 439/374
2014/0248785 A1 * 9/2014 Little ..... H01R 13/6585 439/95

* cited by examiner

*Primary Examiner* — Tulsidas C Patel
*Assistant Examiner* — Peter G Leigh
(74) *Attorney, Agent, or Firm* — Michael Best & Friedrich, LLP

(57) ABSTRACT

A tamper resistant receptacle having hot and neutral shutters and hot and neutral doors disposed in a housing. Simultaneous insertion of hot and neutral blades of an electrical plug allow the shutters to be actuated and the doors moved a distance sufficient to allow the plug blades to access the electrical contacts of the device. If only one plug blade opening in accessed, the blocking face of the shutter prevents further movement of the blade and denies access to the electrical contact disposed beneath the shutter.

1 Claim, 10 Drawing Sheets

TAMPER RESISTANT RECEPTACLE

CROSS-REFERENCE TO RELATED APPLICATIONS

The present application claims the benefit of priority under 35 U.S.C. §102(e) to U.S. Provisional Application No. 62/053,877, filed Sep. 23, 2014, the contents of which are hereby incorporated by reference in their entirety.

FIELD OF THE INVENTION

The present invention relates to tamper resistant electrical receptacles. More particularly, the present invention relates to tamper resistant electrical receptacles using cooperating doors and spring biased shutters.

BACKGROUND OF THE INVENTION

Tamper resistant receptacles are known in the art. "Tamper Resistant" or "TR" receptacles are a class of electrical receptacle outlets configured to deny access to the device's electrical contacts unless force is applied simultaneously to both the hot and neutral plug openings of the device pursuant to NEC Code 406.11 et seq. The Code and related regulatory requirements provide that not only must the outlet openings remain blocked unless force is applied to both openings at the same time, but also that any foreign object 1/32 inch or larger, must be prevented from bypassing the blocking member of a plug opening.

As will be appreciated, these requirements were enacted in response to the phenomena of small children curiously inserting a small toy or metal object into the hot or neutral opening of a receptacle and suffering electrical shock, burns, or even death.

In meeting the standard and providing the level of protection sought from these devices, the art has gravitated towards a configuration of receptacles utilizing cooperating shutter members to block access beyond the faceplate openings of the outlet. Specifically, to ensure that force directed into only one of the two blade openings is prevented from reaching the electrical contact that lies beneath, a sliding shutter mechanism is spring-biased into a position blocking (or "shuttering") the blade opening from underneath the faceplate. The shutter physically prevents an object entering the blade opening from reaching the electrical contact below that shutter. In order to allow the shutter of a respective blade opening to be uncovered, the spring-bias must be overcome by a camming action caused by the other plug blade during insertion in the other blade opening.

To this end, the most common prior art configuration of a TR receptacle includes a shutter assembly comprising a pair of cooperating shutters. Each of the shutters includes a blocking portion positioned below a respective one of the blade openings blocking access to the contacts. Each of the shutters also includes a cam portion that extends to the opposite blade opening that receives contact from a plug blade and translates the vertical force of a plug blade and camming action into a lateral sliding displacement of the blocking portion. Thus, force by vertical insertion of a plug-blade on the neutral blade opening will move the shutter from obstructing access to the electrical contact below the hot blade opening, and vice versa. Specifically, for example, during insertion of a plug, the neutral blade tine will cam against and past the shutter cam surface forcing the shutter cam arm to move laterally, thereby overcoming the spring bias of the shutter and causing the hot blade shutter blocking portion to slide into a position away from and revealing the electrical contact beneath the hot blade opening. Likewise, force on the hot blade opening will contact the cam surface and allow the blade to cam past and move the arm and compress the spring to move the shutter blocking portion that covers the neutral blade opening out of the way. As will be appreciated, with this configuration, when a child tries to insert a toy into either opening of the outlet, the blocking portion of the shutter remains immobile from the spring bias of the opposite shutter and prevents the child from reaching the electrical contact. However, when both blades of an electrical plug contact the shutters simultaneously, the simultaneous force and camming action allows both blades to continue their downward insertion by simultaneously sliding respective shutter blocking portions laterally out of the way of the electrical contacts of the opposite shutter until the blades cam past the shutters and are able to properly "plug in" to the outlet's internal face contacts.

Existing prior art TR receptacle designs and their operational details are available in U.S. Pat. No. 4,379,607 to Bowden, Jr.; U.S. Pat. No. 7,645,148 to Carbone et al.; and U.S. Publ. No. 2013/0295788 to Baldwin, et al. and the references cited therein, the entire contents of which are hereby incorporated by reference in their entirety.

A drawback of these prior art devices recognized by the present inventor is that many conventional TR receptacle designs cannot accommodate deployment in a 20A receptacle due to the inability to provide sufficient clearance for the perpendicularly oriented neutral blade of the plug. Another drawback with some prior art devices is that the respective shutters are spring-biased towards one another, meaning that additional insertion force may be necessary to overcome the friction caused by the shutters sliding over one another in opposite directions.

The foregoing underscores some of the problems associated with conventional TR receptacles. Furthermore, the foregoing highlights the long-felt, yet unresolved need in the art for a TR receptacle with cooperating shutters that is effective in 20A receptacles having a perpendicular neutral blade receiving slot. Moreover, the forgoing highlights the long-felt, yet unresolved need in the art for a TR receptacle design that may be modified to accommodate a 20A neutral blade at a reasonable cost.

SUMMARY OF THE INVENTION

Various embodiments of the present invention overcome various of the aforementioned and other disadvantages associated with prior art TR receptacles and offers new advantages as well. Although not wishing to be bound by theory, the present inventor recognizes that providing lateral movement of a pivoting shutter may allow for sufficient clearance for a neutral plug opening.

According to one aspect of various embodiments of the present invention there is provided a TR receptacle having cooperating doors wherein neutral door is configured to pivot as well as slide forward during actuation. In accordance with this aspect, an advantageous feature is that the forward movement is sufficient to provide clearance for a perpendicularly oriented neutral blade of a 20A electrical plug.

According to another aspect of various embodiments of the present invention, there is provided a TR receptacle wherein the cooperating doors both pivot in the same direction. This configuration allows the device to be configured to have one door cam against one shutter to push it open while the other door cams against the opposite shutter to pull it open.

The invention as described and claimed herein should become evident to a person of ordinary skill in the art given the following enabling description and drawings. The aspects and features of the invention believed to be novel and other elements characteristic of the invention are set forth with particularity in the appended claims. The drawings are for illustration purposes only and are not drawn to scale unless otherwise indicated. The drawings are not intended to limit the scope of the invention. The following enabling disclosure is directed to one of ordinary skill in the art and presupposes that those aspects of the invention within the ability of the ordinarily skilled artisan are understood and appreciated.

BRIEF DESCRIPTION OF THE DRAWINGS

Various aspects and advantageous features of the present invention will become more apparent to those of ordinary skill when described in the detailed description of preferred embodiments and reference to the accompany drawing wherein.

DETAILED DESCRIPTION OF A PREFERRED EMBODIMENT

Figure 1A:
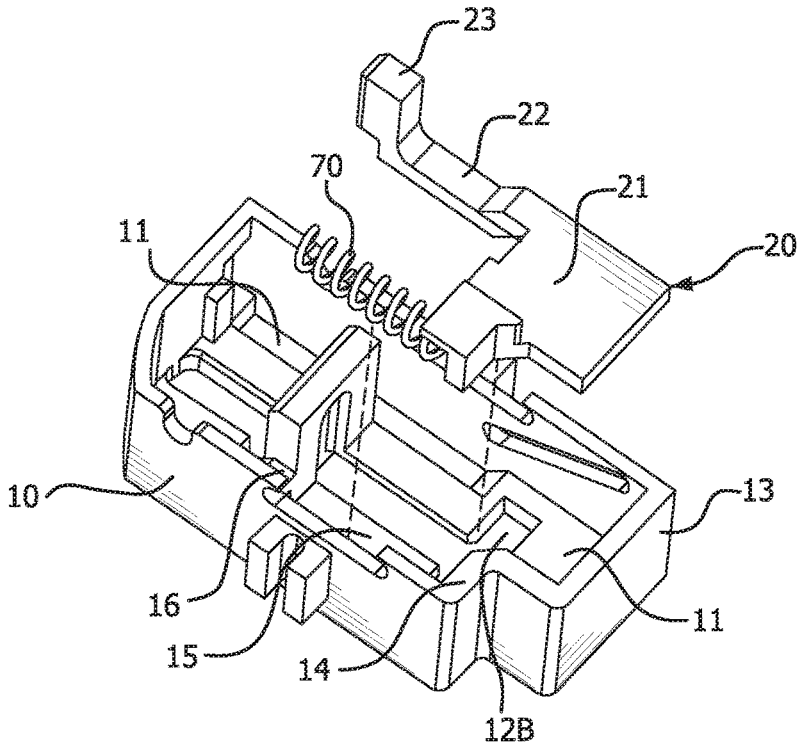
FIG. 1A is a top perspective exploded view of a TR housing and 20A shutter of a TR sub-assembly of a TR receptacle according to one embodiment of the present invention.
Figure 1B:
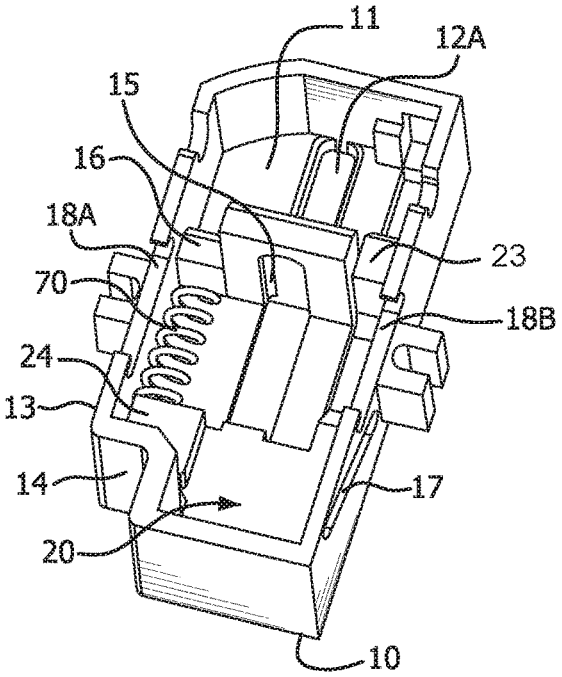
FIG. 1B is a top perspective view of the 20A shutter deployed in the TR housing of the TR sub-assembly depicted in FIG. 1A.
Figure 2A:
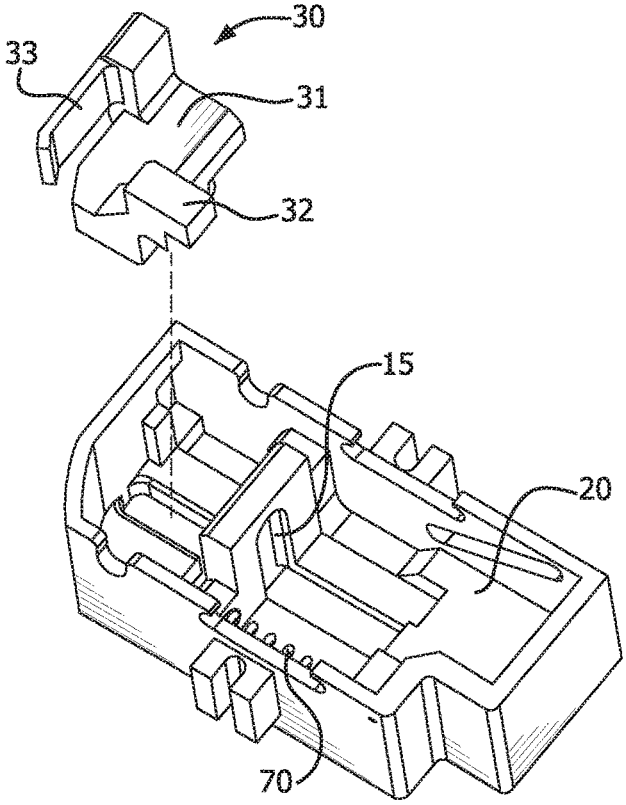
FIG. 2A is a top perspective exploded view of a TR housing and 15A shutter of a TR sub-assembly of a TR receptacle according to an embodiment of the invention.
Figure 2B:
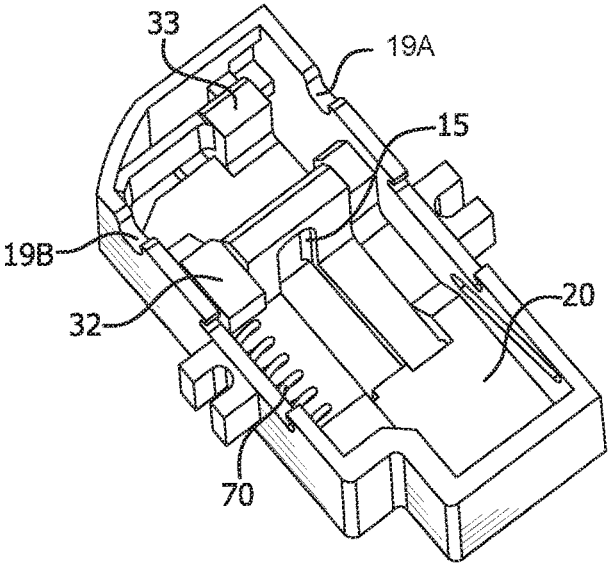
FIG. 2B is a top perspective view of the 15A shutter deployed in the TR housing of the TR sub-assembly depicted in FIG. 2A.
Figure 3A:
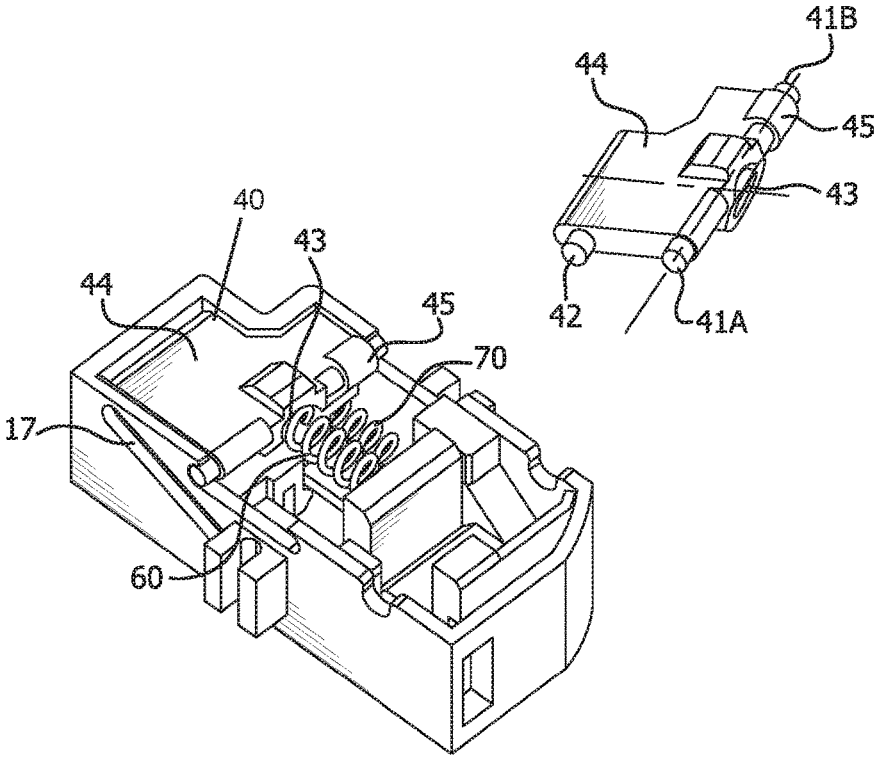
FIG. 3A is a top perspective view of a TR receptacle sub-assembly with the 20A door removed.
Figure 3B:
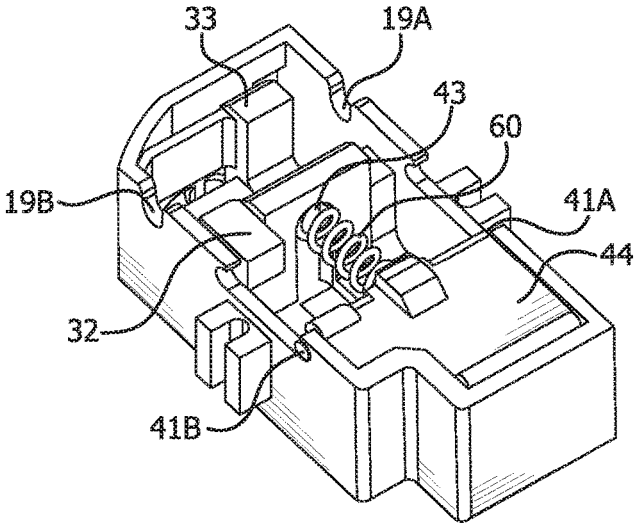
FIG. 3B is a top perspective view of a TR receptacle sub-assembly with the 20A door deployed.
Figure 4A:
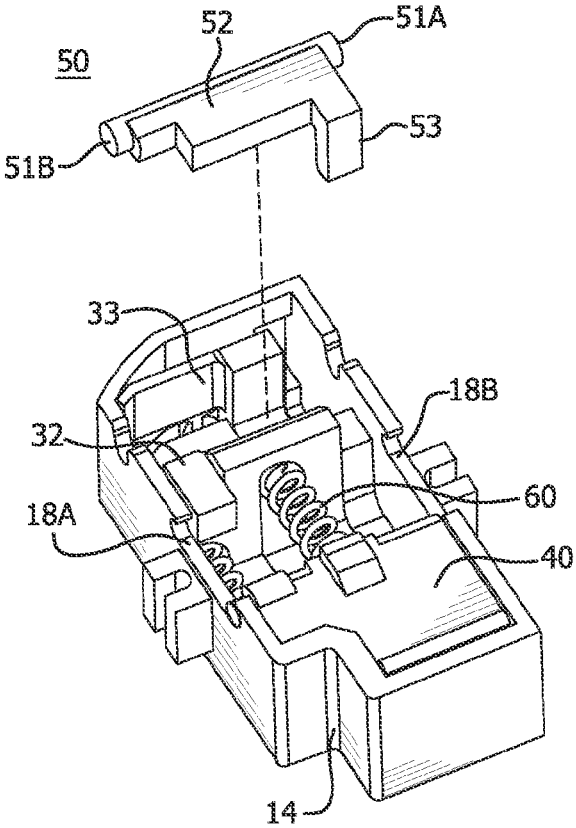
FIG. 4A is a top perspective view of a TR receptacle sub-assembly with the 15A door removed.
Figure 4B:
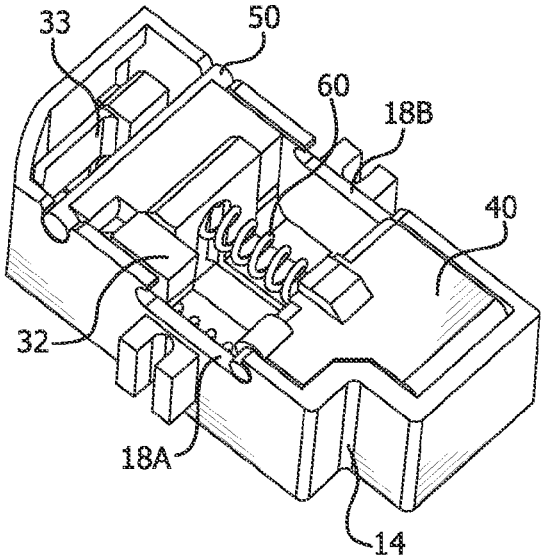
FIG. 4B is a top perspective view of a TR receptacle sub-assembly with the 15A door deployed.
Figure 5A:
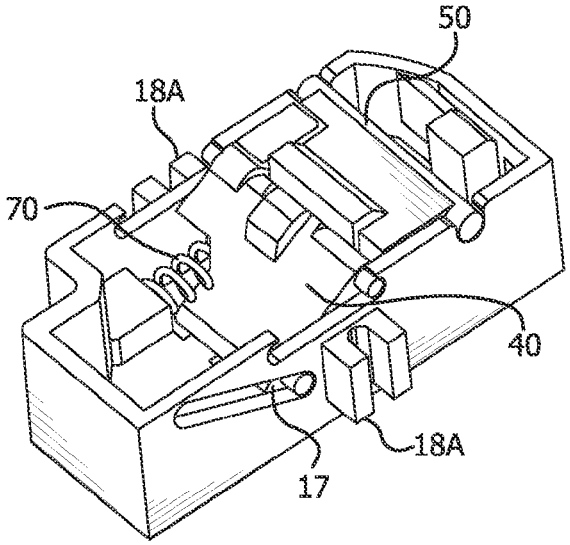
FIG. 5A-C depicts a TR sub-assembly during actuation of the 20A door.
Figure 5B:
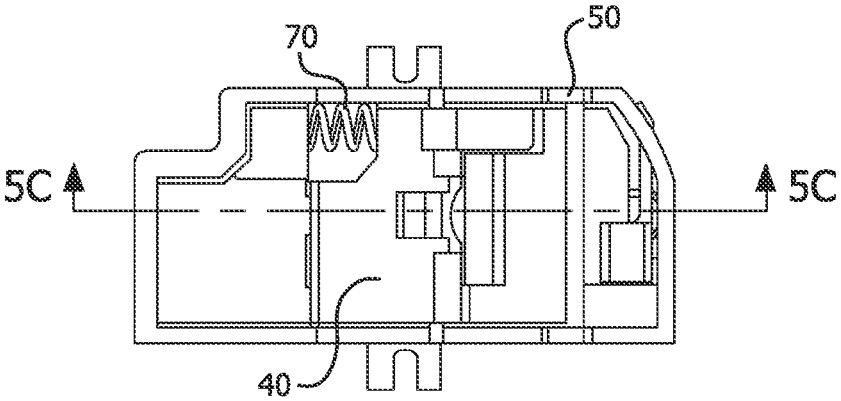
Figure 5C:
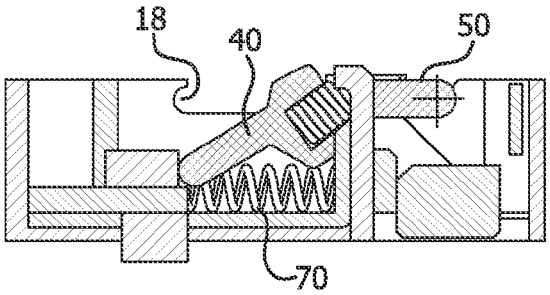
Figure 6A:
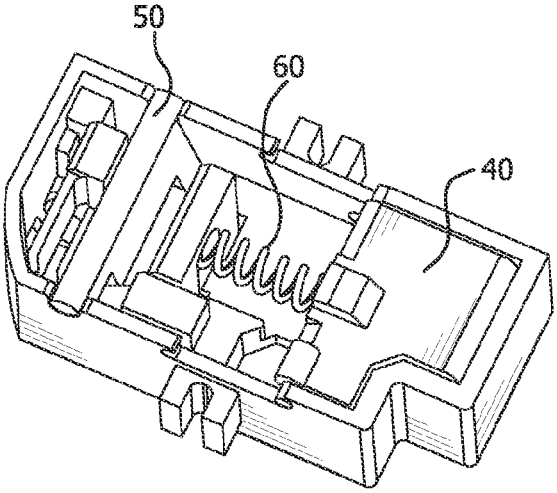
FIG. 6A-C depicts a TR sub-assembly during actuation of the 15A door.
Figure 6B:
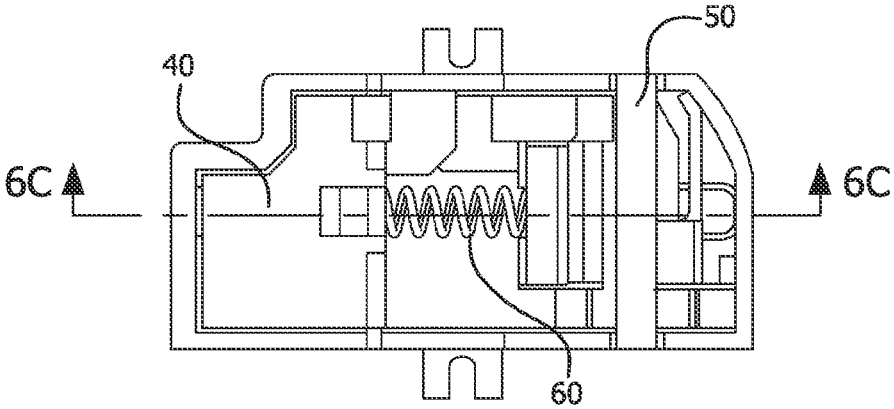
Figure 6C:
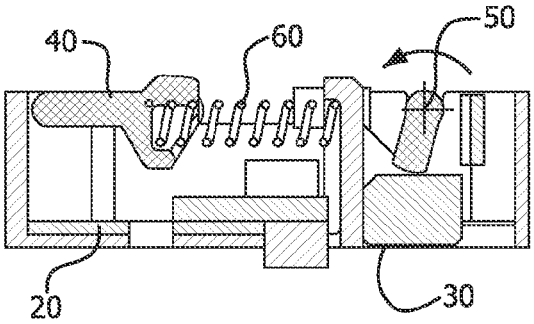
Figure 7A:
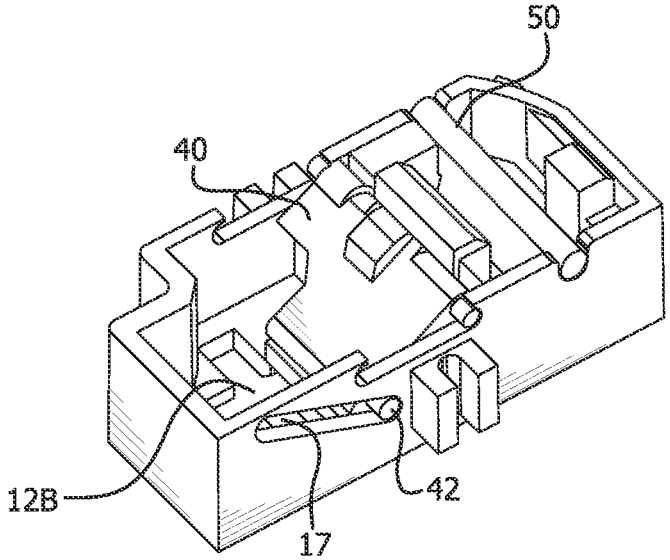
FIG. 7A-D depicts a TR sub-assembly during proper insertion of an electrical plug (plug not shown)
Figure 7B:
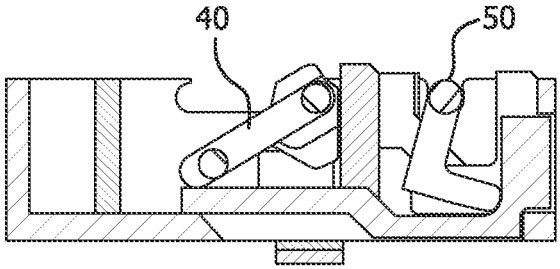
Figure 7C:
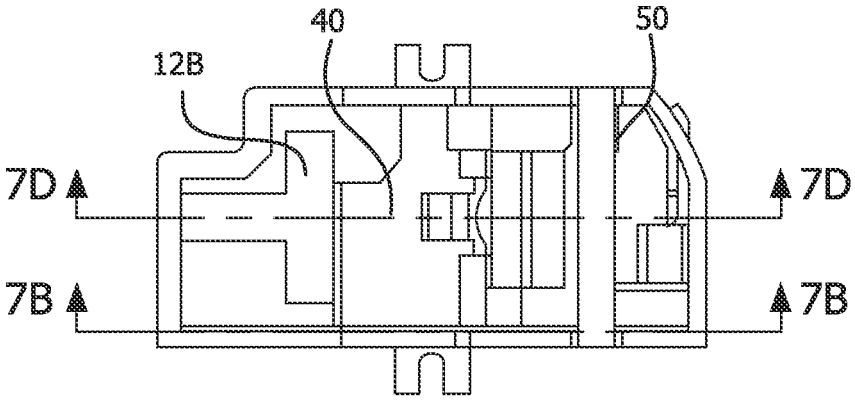
Figure 7D:
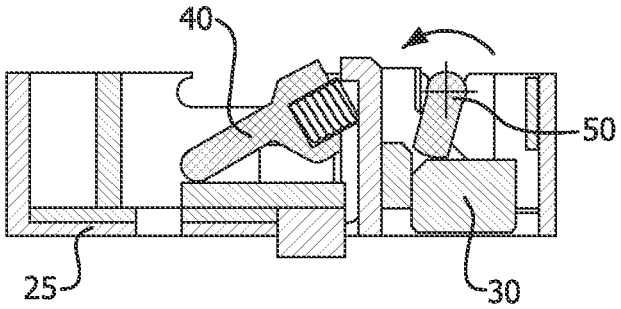
Figure 8:
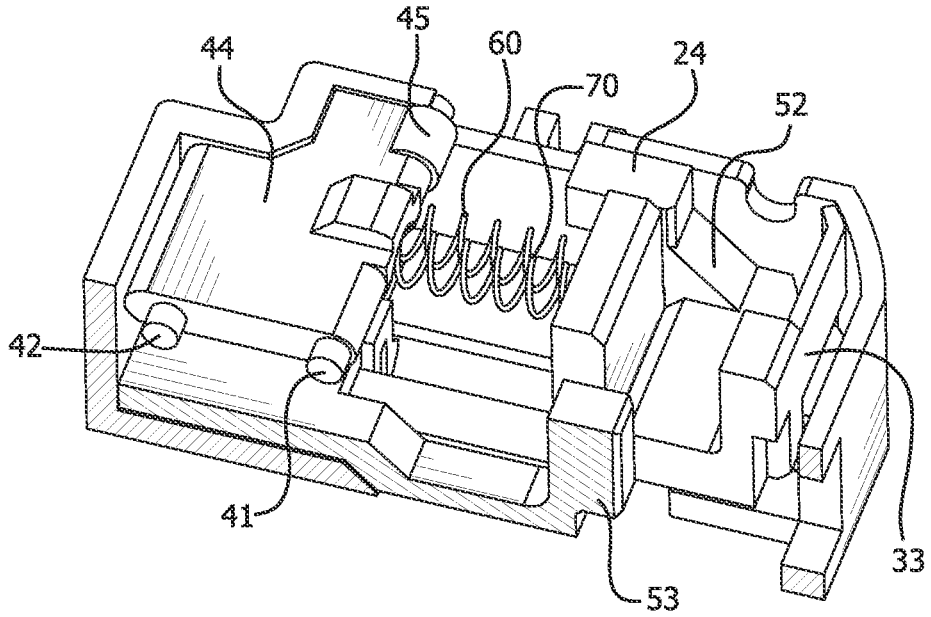
FIG. 8 depicts a perspective side view in partial section of a fully assembled TR sub-assembly when closed.
Figure 9:
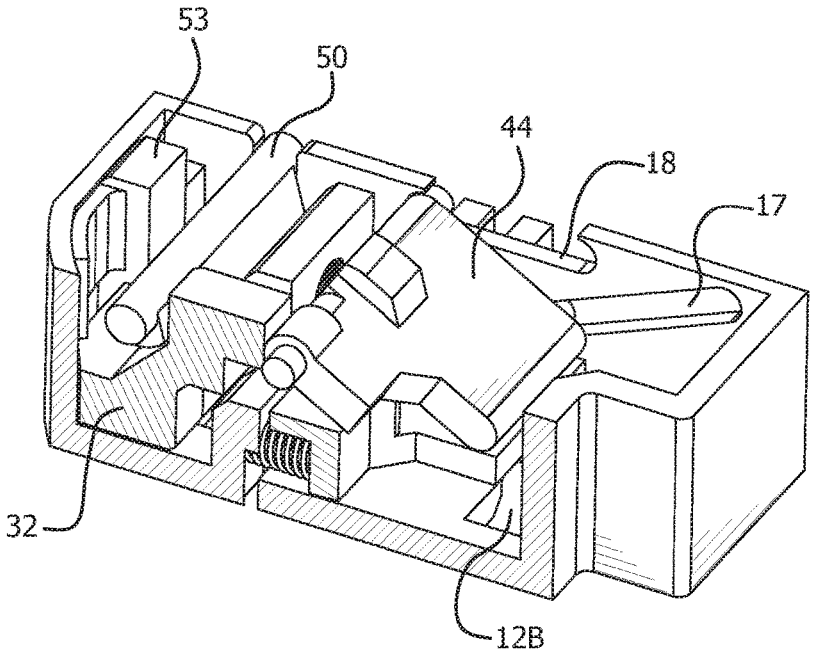
FIG. 9 depicts a perspective side view in partial section of a fully assembled TR sub-assembly when open.

The Figures depict a presently preferred embodiment of a TR receptacle sub-assembly for use in a TR receptacle which makes use of cooperating doors and spring-loaded shutters adapted for use in a 20A receptacle. As shown, the sub-assembly includes a TR housing 10. The housing includes a bottom 11 having hot and neutral openings 12A, 12B. The housing further includes a sidewall 13 forming a cavity and including a shoulder 14 in the "neutral" end of the housing 10. The housing also includes a central spring seat 15 and a side spring seat 16. The housing sidewall 13 also includes a diagonal slot 17 and a pair of oppositely disposed elongated post slots 18A, 18B on the neutral side of the housing 10. The housing sidewall 13 includes a pair of post slots 19A, 19B on the hot side of the housing 10.

Disposed in the housing 10 adjacent the bottom 11 is a first, or "neutral", shutter 20 which is operatively positioned above the neutral plug opening 12B above the neutral contact (not shown). The neutral shutter 20 includes a blocking face 21 which blocks access to the neutral opening 12B when in the closed position. The neutral shutter 20 also includes an elongated arm portion 22 terminating in a raised cam receiving contact head 23. On the opposite side of the neutral shutter 20 there is a raised spring head 24 that rests against the shoulder 14 of the housing and which includes a first spring seat 25 for receiving a first helical spring member 60 disposed on the shoulder 14 side of the housing 10.

Also disposed in the housing 10 adjacent the bottom 11 is a second, or "hot", shutter 30 which is operatively positioned above the hot opening 12A above the hot contact (not shown). The hot shutter 30 includes a blocking face 31 which blocks access to the hot opening 12B when in the closed position. The hot shutter 30 also includes a raised contact head 32 that is positioned on the shoulder side of the housing as well as a raised back flexible arm portion 33 that is in contact but flexed against and away from the back of the sidewall 15 on the hot side of the housing 10.

Positioned above the shutters are pivoting doors 40, 50. The doors 40, 50 lies below the faceplate of the receptacle (not shown) and operationally rest on the top edge of the sidewall 13. Positioned above the neutral shutter 20 and below the neutral prong opening of the faceplate is the neutral door 40. The neutral door 40 includes a pair of pivot pins 41A, 41B on opposite sides of the door 40 which sit in the elongated slots 18A, 18B of housing 10. The neutral door 40 also includes a slot pin 42 that rides in the diagonal slot 17 of housing 10. The neutral door 40 further includes a second spring seat 43 for accepting central helical spring 70. The neutral door 40 is generally planar and comprises a plug receiving surface 44 for accepting contact from a neutral plug blade and a cam head 45 portion for contacting the contact head 32 of the hot shutter 30.

Positioned above the hot shutter 30 and below the hot prong opening of the faceplate is the hot door 50. The hot door 50 includes a pair of oppositely disposed pivot pins 51A, 51B which sit in respective pivot slots 19A, 19B of the housing 10. The hot door 50 comprises a generally planar plug receiving surface 52 for accepting contact from a hot plug blade and a cam leg member 53 which is a generally L-shaped leg designed to contact the contact head 23 of the neutral shutter 20 to pull it laterally by overcoming the bias of first helical spring member 60.

As best discerned from the Figures, the tamper-resistant features of the device are achieved by requiring both doors to be contacted simultaneously so that both shutters can be moved to reveal the plug openings 12A, 12B in the bottom 11 of the housing 10. If either door 40, 50 fails to actuate when an object is inserted into one of the blade openings in the faceplate, the corresponding shutter will fail to move and the object cannot pass to the electrical contact of the device.

In operation, when a 20A plug blade is inserted into the faceplate of the device, the hot blade tine will contact the hot door 50 and cause the door to pivot downwardly. The downward rotation will rotate L-shape cam leg 53 in a manner that will push cam head 23 and thus pull the neutral shutter 20 towards the middle of the housing 10 (by overcoming the bias of first helical spring member 60) a distance sufficient to reveal the T-shaped neutral opening of a 20A receptacle. At the same time, when the neutral blade tine contacts the neutral door 40, the force of the tine rotates the door 40 downwardly as well as laterally (by overcoming the bias of central spring 70) as the pins travel in the elongated slots 18A, 18B and diagonal slot 17. The downward pivoting and forward motion of the door 40 allows sufficient clearance for the perpendicular neutral blade of an electrical plug to pass there through. In addition, the forward motion of the door 40 serves to carry the cam head 45 of the door 40 into contact with the contact head 32 of the hot shutter 30 with sufficient force to overcome the bias of the flexible arm 33 and move the hot shutter 30 back far enough to uncover the hot blade opening 12B in the bottom 11 of the housing 10. Once the tines of the plug are removed, the spring bias of the helical springs and flexible arm return the shutters and doors to their original positions to close access to the contacts of the receptacle.

Accordingly, one of ordinary skill will appreciate that the exact dimensions and materials are not critical to the invention and all suitable variations should be deemed to be within the scope of the invention if deemed suitable for carrying out the objects of the invention.

Likewise, one of ordinary skill in the art will readily appreciate that it is well within the ability of the ordinarily skilled artisan to modify one or more of the constituent parts for carrying out the various embodiments of the invention. Once armed with the present specification, routine experimentation is all that is needed to decide the parameters to adjust for carrying out the present invention.

The above embodiments are for illustrative purposes and are not intended to limit the scope of the invention or the adaptation of the features described herein to particular TR receptacles. Those skilled in the art will also appreciate that various adaptations and modifications of the above-described preferred embodiments can be configured without departing from the scope and spirit of the invention. Therefore, it is to be understood that the invention may be practiced other than as specifically described.

What is claimed is:

1. A tamper resistant receptacle comprising:

a housing including a bottom having hot and neutral plug blade passages, a sidewall forming a cavity, and a shoulder in a neutral end of the housing;

a central spring seat having a central helical spring disposed therein;

a diagonal slot and a pair of oppositely disposed elongated post slots disposed on the neutral end of the housing;

a pair of post slots on a hot side of the housing;

a hot shutter and a neutral shutter;

a hot door disposed beneath said hot shutter and a neutral door disposed beneath said neutral shutter, said doors operationally resting on a top edge of the sidewall;

the neutral shutter includes a blocking face which blocks access to the neutral opening when in the closed position and an elongated arm portion terminating in a raised cam receiving contact head;

a raised spring head that rests against the shoulder of the housing and which includes a spring seat for receiving a first helical spring member;

the hot shutter includes a blocking face which blocks access to the hot opening when in the closed position and including a raised contact head that is positioned on the shoulder side of the housing as well as a raised back flexible arm portion that is in contact but flexed against and away from a back of the sidewall on the hot side of the housing;

whereby both doors must be contacted simultaneously to move said shutters to allow tines of an electrical plug to access electrical contacts in said tamper resistant receptacle.

* * * * *